United States Patent [19]

Fazio

[11] Patent Number: 4,938,515

[45] Date of Patent: Jul. 3, 1990

[54] GRIPPER NAPKIN

[76] Inventor: Sebastian C. Fazio, 3596 Warren Rd., Cleveland, Ohio 44111

[21] Appl. No.: 177,615

[22] Filed: Apr. 5, 1988

[51] Int. Cl.[5] ..... B65D 65/30

[52] U.S. Cl. ..... 294/25; 2/21; 229/DIG. 13; 229/87.08; 294/1.1; 426/115; 426/132

[58] Field of Search ..... 294/1.1, 1.3, 16, 25, 294/27.1, 33, 137; 2/16, 20, 21, 158, 159, 163, 164; 15/227; 229/1.5 R, 87 R, 87 F, 87.5, DIG. 1, DIG. 7, DIG. 13; 426/15, 132; D6/595; D29/20

[56] References Cited

U.S. PATENT DOCUMENTS

| | | | |
|---|---|---|---|
| 2,647,785 | 8/1953 | Casnati | 294/25 |
| 2,751,592 | 6/1956 | Longstreth et al. | 2/21 |
| 3,255,876 | 6/1966 | Wolf | 294/25 X |
| 3,331,626 | 7/1967 | Kaufman | 294/25 X |
| 3,355,082 | 11/1967 | Wood | 426/115 X |
| 3,407,927 | 10/1968 | Jones | 294/25 X |
| 3,446,416 | 5/1969 | Epstein | 229/DIG. 13 |
| 3,503,759 | 3/1970 | Wilton | 229/DIG. 13 |

FOREIGN PATENT DOCUMENTS

| | | | |
|---|---|---|---|
| 933057 | 9/1955 | Fed. Rep. of Germany | 294/25 |
| 462585 | 3/1951 | Italy | 294/25 |
| 1450683 | 9/1976 | United Kingdom | 294/25 |

*Primary Examiner*—Johnny D. Cherry

*Attorney, Agent, or Firm*—Pearne, Gordon, McCoy & Granger

[57] ABSTRACT

A napkin is disclosed that in use may be formed into a mitten-like gripper for protecting the hand from soiling and heat while the hand firmly grips, for example, a hamburger. The napkin comprises a sheet of multi-layer absorbent material with two arcuate slits through less than all of the layers. The slits are disposed about the center of the sheet. In use, the napkin is folded in half with a slit on each of the outer sides. The user inserts his thumb in one slot and one or more fingers in the other slot. The edges of the layers may be bonded together to improve the performance of the napkin as a gripper.

15 Claims, 1 Drawing Sheet

GRIPPER NAPKIN

The invention relates to napkins with fingers and thumb pockets for gripping food or other objects.

The pervasive popularity of fast food outlets has contributed to the ever-increasing popularity of food meant to be eaten with the fingers. Such food is many times both messy and hot. Sandwich condiments and grease often soil the hands during the eating process.

Conventional napkins are useful in cleaning up the aftermath of the eating process, but are of little help in preventing the soiling of the hands or in protecting the fingers from the heat of the food. This is because conventional napkins are ill-suited to grip the food and protect the hand simultaneously. It is awkward to simultaneously maintain the napkin in a position to protect the hand and to grip the food.

The prior art discloses a variety of disposable holders for food products which are specifically configured for gripping particular shaped items. A pleated-clam shell-like envelope for holding hamburgers is disclosed in U.S. Pat. No. 4,641,752. U.S. Pat. No. 4,608,259 discloses an elongate holder for tacos. A sandwich or hamburger holder which is foldable to a U-shape is disclosed in U.S. Pat. No. 3,466,416. In non-napkin type applications, protective mitts having fingers and thumb openings are shown in U.S. Pat. Nos. 3,608,708, 2,763,864, 1,990,553 and 580,148. U.S. Pat. No. 2,654,111 discloses a cosmetic applicator comprising a folded tissue having an opening for receiving the user's fingers. U. S. Pat. No. 4,397,754 discloses a personal cleaning product comprising a flexible foam sheet having slits therethrough for receiving the fingers and thumb of the user.

SUMMARY OF THE INVENTION

In accordance with the present invention, a multiple layer napkin is provided which is useful as a mitten-like gripper or as a conventional protective cover. For use as a mitten-like gripper, the napkin includes integrally formed pockets for receiving the users hand digits to better manipulate the napkin and grip a food product or the like.

The integrally formed pockets are provided by one or more access openings through at least the outermost layer of the napkin. The access openings may comprise an opening of sufficient area to receive the users digits or one or more slits or cuts through which the user's fingers and thumb extend. The slits or cuts may be preformed or partially formed by perforation patterns which the user can rupture by hand manipulation to provide a slit or an opening of desired size.

Conventional disposable napkins formed of an absorbent paper material and folded during manufacture to provide superimposed overlaying layers may be provided with one or more access openings through less than all of the layers in accordance with the invention. In a preferred embodiment, two arcuate slits or perforation patterns are provided about the center of the surface area of the manufactured folded napkin. In such an embodiment, the peripheral edges of the overlaying layers may be joined by a fold or they may not be joined. All of the peripheral edges of the folded napkin may be joined during manufacture by conventional means such as an adhesive or a self-stitching of the napkin material to enhance the gripping function.

To use the napkin as a gripper, the napkin is folded by the user so that access openings are positioned on opposite outer sides of the folded napkin. The user then places a thumb through one access opening and one or more fingers through the other access opening with the user fold line towards the palm of the hand. A mitten-like gripper is thus achieved. A conventional disposable napkin may be modified to provide such a mitten-like gripper without significant additional manufacturing costs by use of known cutting or perforation techniques.

In another embodiment of the invention, the corners of a napkin folded to a rectangular configuration are removed during manufacture to provide an octagonal shape napkin which enables easier access to the food item being held. In another embodiment of the invention, a generally circular multi-layer sheet with bonded edges is used. In each of these embodiments, the edges of the overlaying layers of the napkin may be joined along all or part of their peripheral extent.

As noted above, the access openings may comprise cuts or slits or a series of perforations that must be torn before the digits may be inserted. The use of perforations enables the user to vary the size of the access openings by tearing a desired distance along the perforation pattern. It is particularly advantageous to limit the size of the access opening for child users.

A design may be advantageously added to the surface of the invention to allow its use as a hand puppet. Such a design would, for example, depict a creature such that the interior of the gripper appeared as a mouth.

DESCRIPTION OF THE PREFERRED EMBODIMENT

Figure 1:
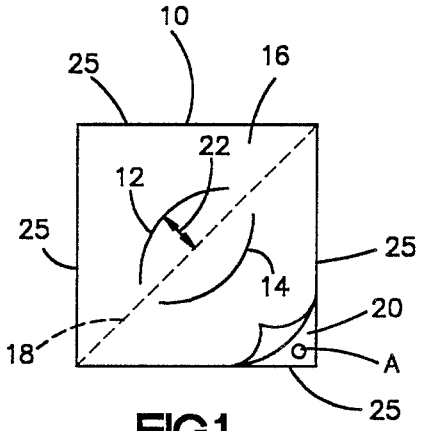
FIG. 1. shows a top plan view of a napkin in accordance with the invention.

Referring to FIG. 1, napkin 10 is a multi-layered rectangular sheet of absorbent material, preferably paper. The napkin 10 is formed of a single sheet of absorbent paper which is folded during manufacture to provide a multi-layered flat napkin in a manner known in the art. For use as a gripper-like mitten, the napkin 10 in its manufactured folded condition is preferably somewhat larger than an adult hand.

Access openings or arcuate slits 12, 14 are shown in an outer or top layer 16 of the napkin 10. The slits 12, 14 are disposed about the center of napkin 10, one on each side of user fold line 18. Fold line 18 may be advantageously located on a diagonal of napkin 10. As shown in FIG. 1, the lower right corner of the top layer 16 is rolled-back to expose an oppositely disposed outer layer or bottom layer 20. If desired, the bottom layer 20 may be formed of a liquid impervious material such as a metal foil plastic.

Slits 12, 14 are oriented such that the interior of each of their arcs is towards fold line 18. Slits 12, 14 extend through less than all of the layers of napkin 10, preferably through only top layer 16. Slits 12, 14 do not extend through bottom layer 20. Each of slits 12, 14 is of sufficient length to admit at least two fingers of an adult hand.

Figure 3:
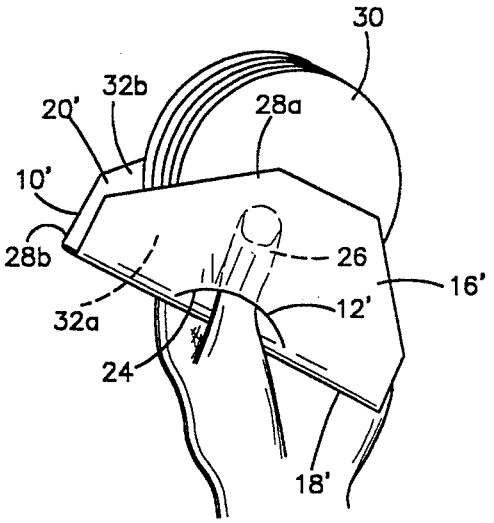
FIG. 3 shows a perspective view of the napkin of the second embodiment being used to grip a food product.

Slits 12, 14 are each located a distance 22 from fold line 18 suitable for providing a mitten-bight sized to grip a food product such as a hamburger and to provide a pocket intermediate each of the slits and the outer napkin periphery which is sized to receive the thumb or fingers of the napkin user. For example, a pocket 24 for receiving either the thumb or fingers is shown in FIG. 3. While not critical, distance 22 is preferably in the order of from one-fourth to one-half of the distance as measured along a perpendicular line from line 18 to the most distant point of napkin 10.

Figure 4:
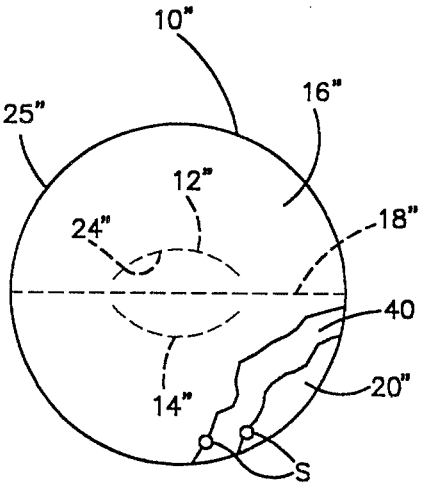
FIG. 4 shows a top plan view of a third embodiment of the invention with portions of the layers broken away.

Slits 12, 14 may be continuous as shown in FIG. 1 or they may comprise an arcuate perforation pattern 12'', 14'' as shown in the embodiment of FIG. 4. In use, the napkin material between the perforations is broken to create continuous slits.

The napkin 10 may be unfolded to provide a single layer protective cover for use in the manner of a conventional napkin. When so used, the continuous area coverage and protection of the napkin 10 is not significantly affected by the presence of slits 12'', 14'' or perforations 12', 14'. The slits 12, 14 tend to remain closed in the plane of the unfolded napkin 10 and the perforations 12'', 14'', are retained closed by the continuous material intermediate the perforations.

Edges 25 which are not joined by a manufacture fold between the layers of the napkin 10 may bonded together to enhance the mitten-like gripping function of the invention. An adhesive "A" (FIG. 1) may be used to permanently or refastenably join the free edges 25. Also, mechanical self-bonding techniques such as stitching or needling "S" (FIG. 4) may be used to temporarily join the free edges together.

Figure 2:
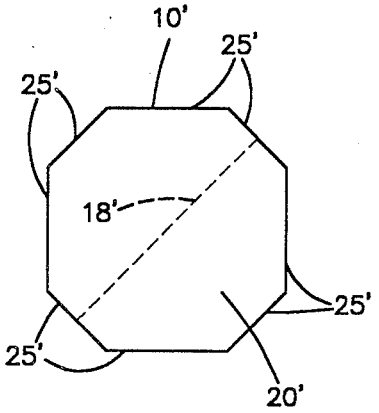
FIG. 2 shows a bottom plan view of a second embodiment of the invention.

FIG. 2 shows a bottom view of a napkin 10' made from a multi-layered sheet of absorbent material in the form of a rectangle with the corners removed to provide an octagonal shape napkin. This embodiment has the advantages of allowing easier access to the gripped food. As shown in FIG. 3, a user's thumb 26 is inserted through the slit 12' located on one outer side **28*a* of the folded napkin 10' and into a pocket 24 provided intermediate layers 16' and 20'. The user's fingers are inserted through slit 14' located on the outer side 28*b* of the folded napkin 10' into an identical pocket 24 (not shown) provided intermediate the layers 16' and 20'. The slits 12' and 14' (not shown) are spaced apart a sufficient distance 22' to grip an object 30, such as a hamburger sandwich between opposed inner sides 32*a* and 32*b* of the folded napkin 10', without stretching and tearing the napkin. Similarly, the slits 12' and 14'** (not shown) are close enough to allow the gripping and manipulation of a relatively small object such as a french fry.

FIG. 4 shows a top plan view of embodiment of the invention. Napkin 10'' is made from a multi-layered sheet of absorbent material having a circular configuration. The napkin 10'' includes an intermediate layer 40 disposed between outer top and bottom layers 16'' and 20. The layers 16'', 40 and 20'' are joined along the edge 25'' of the napkin 10'' by mechanical stitching "S".

In the napkin 10'', the perforation patterns 12'', 14'' are converted to slits of desired size by the user tearing or rupturing the napkin material between adjacent perforations. The perforation patterns 12'', 14'' and resulting slits extend through only the outer layer 16''. Accordingly, the finger and thumb pockets 24'' are disposed intermediate the layers 16'' and 40 and extend between each of the patterns 12'', 14'', and the adjacent portion of the edge 25'' of the napkin.

Referring once again to the napkin 10 shown in FIG. 1, it should be appreciated that the adjacent ends of the slits 12 and 14 may be joined by extension of the slits to provide an oval-shape continuous cut or slit. The resulting oval-shape cut-out may be removed during manufacture to provide an access opening. Similarly, the arcuate perforation patterns 12'', 14'', in the napkin 10'' may be extended to provide a closed perforation pattern enclosing an oval-shape portion of the layer 16'' which may be removed by the napkin user to provide an access opening.

A design may be added to the top 16 and bottom 20 of napkin 10 to depict a real or imaginary creature, the mouth of which is constituted by the opposed surfaces of the layer 20 when the napkin is worn by the user as a mitten-like gripper. Napkin 10 may then be used as a hand puppet.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

I claim:

1. A napkin for use by a person, comprising a multi-layered sheet having opposed first and second layers of absorbent material for use in a generally flat configuration as a napkin to provide a substantially continuous protective cover, said napkin also having two spaced cuts through said first layer, said cuts being disposed adjacent the center of the sheet and opening into an intermediate pocket means between the layers, said cuts being sufficiently spaced from each other to enable the napkin user to fold the napkin along a bisecting line with the cuts on opposite outer sides of the fold to cause said second layer to form a mitten-bight sized to grip a food product upon insertion of opposed digits of his hand through the cuts and into the intermediate pocket means to form a mitten-like napkin, each of said spaced cuts having an arcuate configuration and being located a distance from the fold line equal to from about $\frac{1}{4}$ to $\frac{1}{2}$ the distance from the fold line to a peripheral edge of the napkin adjacent to the cut.

2. A napkin according to claim 1, wherein said sheet has a rectangular shape and said fold line extends diagonally between opposite corners of the napkin.

3. A napkin according to claim 1, wherein said sheet has an octagonal shape.

4. A napkin according to claim 1, wherein said sheet has a circular shape.

5. A napkin for use in a generally flat configuration to provide a substantially continuous protective cover or in a folded configuration as a gripper-like mitten to facilitate the gripping of a food product or the like comprising a plurality of layers of flexible sheet material having oppositely disposed first and second outer layers, opening means for providing access through at least one of said first and second outer layers to pocket means intermediate said layers for receiving with folding of the napkin opposed digits of the napkin user to grip a food product or the like by engagement thereof with the other of said first and second outer layers, said opening means comprising hand disconnectable perforations arranged to form at least one access opening in said one of said first and second outer layers and to cause said other layer to form a mitten-bight sized to grip said food product.

6. A napkin according to claim 5, wherein said opening means are manually manipulatable by the user to provide said at least one access opening of desired size within a predetermined range of sizes.

7. A napkin according to claim 5, wherein said opening means are manually manipulatable by the user to provide a plurality of spaced access openings.

8. A napkin according to claim 7, wherein said opening means are manually manipulatable by the user to provide each of said spaced openings with a user selected sizes within a predetermined range of sizes.

9. A napkin according to claim 5, wherein said napkin has a peripheral edge and said layers of sheet material are connected along at least a portion of the peripheral edge of the napkin.

10. A napkin according to claim 9, wherein said layers of sheet material are integrally connected along said peripheral edge of the napkin.

11. A napkin according to claim 9, wherein said layers of sheet material are connected by an adhesive along said peripheral portion of the napkin.

12. A napkin according to claim 9, wherein said layers of sheet material are connected by mechanical stitching along said peripheral portion of the napkin.

13. A napkin for use by a person, comprising a multi-layered sheet having opposed first and second layers of absorbent material for use in a generally flat configuration as a napkin to provide a substantially continuous protective cover, said napkin also having two spaced cuts through said first layer, said cuts being disposed adjacent the center of the sheet and opening into an intermediate pocket means between the layers, said cuts being sufficiently spaced from each other to enable the napkin user to fold the napkin along a bisecting line with the cuts on opposite outer sides of the fold to cause said second layer to form a mitten-bight sized to grip a food product upon insertion of opposed digits of his hand through the cuts and into the intermediate pocket means to form a mitten-like napkin, each of said cuts having a major dimension which extends in a direction substantially parallel with said fold.

14. A napkin according to claim 13, wherein said multi-layered sheet includes only said first and second layers, said layers are substantially coextensive and include overlying peripheral edges and said layers are bonded together at said peripheral edges thereof.

15. A napkin according to claim 14, wherein said first and second layers comprise sheets of absorbent paper.

* * * * *